US011333407B2

(12) United States Patent
Xu

(10) Patent No.: US 11,333,407 B2
(45) Date of Patent: May 17, 2022

(54) GM CRYOCOOLER WITH BUFFER VOLUME COMMUNICATING WITH DRIVE CHAMBER

(71) Applicant: SUMITOMO HEAVY INDUSTRIES, LTD., Tokyo (JP)

(72) Inventor: Mingyao Xu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 173 days.

(21) Appl. No.: 16/564,015

(22) Filed: Sep. 9, 2019

(65) Prior Publication Data

US 2020/0003459 A1 Jan. 2, 2020

Related U.S. Application Data

(63) Continuation of application No. PCT/JP2018/004998, filed on Feb. 14, 2018.

(30) Foreign Application Priority Data

Mar. 10, 2017 (JP) ..... JP2017-046441

(51) Int. Cl.
*F25B 9/14* (2006.01)
*F25B 9/00* (2006.01)

(52) U.S. Cl.
CPC ..... *F25B 9/145* (2013.01); *F25B 9/00* (2013.01); *F25B 2309/006* (2013.01); *F25B 2309/1411* (2013.01); *F25B 2309/1421* (2013.01)

(58) Field of Classification Search
CPC .... F25B 9/00; F25B 9/14; F25B 9/145; F25B 2309/006; F25B 2309/1411
See application file for complete search history.

(56) References Cited

U.S. PATENT DOCUMENTS

| | | | | |
|---|---|---|---|---|
| 5,009,072 | A | 4/1991 | Nagao | |
| 5,345,770 | A * | 9/1994 | Inaguchi | F25B 9/14 60/520 |
| 5,471,841 | A | 12/1995 | Inaguchi | |
| 6,279,324 | B1 * | 8/2001 | Zhu | F25B 9/14 60/520 |
| 9,829,218 | B2 | 11/2017 | Xu | |
| 2013/0074523 | A1 * | 3/2013 | Xu | F25B 9/14 62/6 |

FOREIGN PATENT DOCUMENTS

| | | | |
|---|---|---|---|
| JP | H03-1053 | A | 1/1991 |
| JP | H05-302764 | A | 11/1993 |
| JP | 3439651 | B2 | 8/2003 |
| JP | 2013-083428 | A | 5/2013 |

* cited by examiner

*Primary Examiner* — Lionel Nouketcha
(74) *Attorney, Agent, or Firm* — HEA Law PLLC

(57) ABSTRACT

A GM cryocooler includes a compressor having a compressor discharge port and a compressor suction port, a displacer capable of reciprocating in an axial direction, a displacer cylinder accommodating the displacer, a drive piston connected to the displacer so as to drive the displacer in the axial direction, a drive chamber in which the drive piston is driven, a main pressure switching valve configured to alternately connect the displacer cylinder to the compressor discharge port and the compressor suction port, an auxiliary pressure switching valve configured to alternately connect the drive chamber to the compressor discharge port and the compressor suction port, and a buffer volume connected between the auxiliary pressure switching valve and the compressor.

1 Claim, 5 Drawing Sheets

GM CRYOCOOLER WITH BUFFER VOLUME COMMUNICATING WITH DRIVE CHAMBER

RELATED APPLICATIONS

The contents of Japanese Patent Application No. 2017-046441, and of International Patent Application No. PCT/JP2018/004998, on the basis of each of which priority benefits are claimed in an accompanying application data sheet, are in their entirety incorporated herein by reference.

BACKGROUND

Technical Field

Certain embodiments of the present invention relate to a Gifford-McMahon (GM) cryocooler.

Description of Related Art

GM cryocooler may be roughly divided into two types, a motor-driven type and a gas-driven type according to a drive source of a displacer. In the motor-driven type, the displacer is mechanically connected to a motor and driven by the motor. In the gas-driven type, the displacer is driven by gas pressure.

SUMMARY

According to an embodiment of the present invention, there is provided a GM cryocooler including: a compressor having a compressor discharge port and a compressor suction port; a displacer capable of reciprocating in an axial direction; a displacer cylinder which accommodates the displacer; a drive piston connected to the displacer so as to drive the displacer in the axial direction; a drive chamber in which the drive piston is driven; a main pressure switching valve configured to alternately connect the displacer cylinder to the compressor discharge port and the compressor suction port; an auxiliary pressure switching valve configured to alternately connect the drive chamber to the compressor discharge port and the compressor suction port; and a buffer volume connected between the auxiliary pressure switching valve and the compressor.

DETAILED DESCRIPTION

Figure 1:
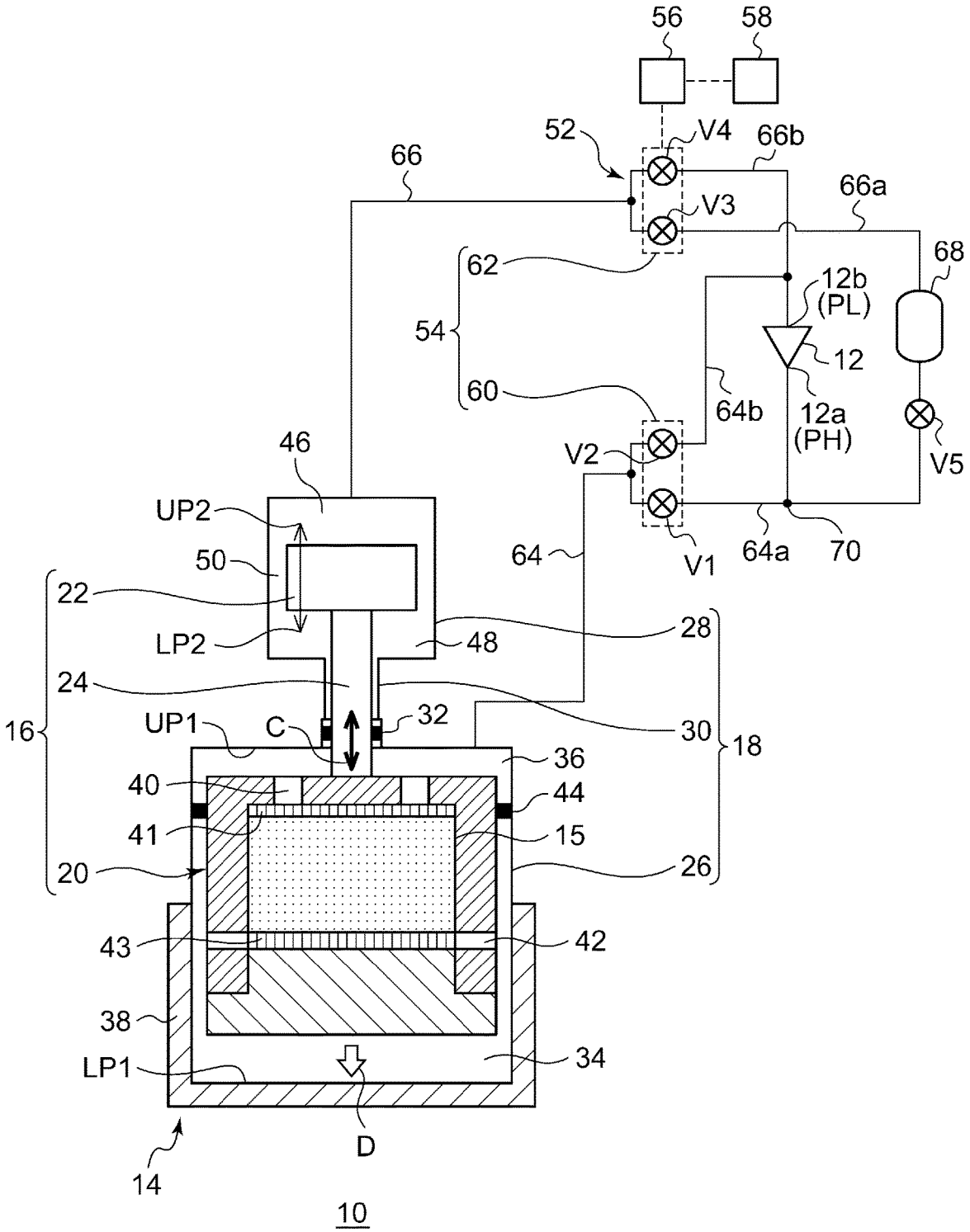
FIG. 1 is a diagram schematically showing a gas-driven type GM cryocooler according to one embodiment.

In the case of the motor-driven type, the stroke of the displacer is determined by a connection mechanism, and therefore, it is easy to design the motor-driven type GM cryocooler such that the displacer does not collide with a cylinder. For example, if a slight gap is provided between the bottom dead center of the displacer and the bottom surface of the cylinder, a collision between the displacer and the cylinder is avoided. However, in a typical gas-driven type GM cryocooler, the displacer continues to move under the action of gas pressure until it collides with or comes into contact with the bottom surface of the cylinder. A collision or a contact of the displacer with the cylinder can cause vibration or abnormal noise.

It is desirable to reduce vibration or abnormal noise in a gas-driven type GM cryocooler.

Configurations in which any combination of the constituent elements described above, or the constituent elements or expressions of the present invention are mutually substituted between methods, apparatuses, systems, or the like are also effective as aspects of the present invention.

According to the present invention, it is possible to reduce vibration or abnormal noise in a gas-driven type GM cryocooler.

Hereinafter, embodiments of the present invention will be described in detail with reference to the drawings. In the description and the drawings, identical or equivalent constituent elements, members, and treatment are denoted by the same reference numerals, and overlapping description thereof will be appropriately omitted. The scales or shapes of the respective parts which are shown are set conveniently for ease of description and are not interpreted in a limited way unless otherwise specified. The embodiments are exemplification and do not limit the scope of the present invention at all. All the features or combinations thereof described in the embodiments are not necessarily essential to the invention.

One Embodiment

FIG. 1 is a schematic diagram showing a GM cryocooler 10 according to one embodiment.

The GM cryocooler 10 includes a compressor 12 which compresses a working gas (for example, helium gas), and a cold head 14 which cools the working gas by adiabatic expansion. The compressor 12 has a compressor discharge port 12*a* and a compressor suction port 12*b*. The compressor discharge port 12*a* and the compressor suction port 12*b* respectively function as a high-pressure source and a low-pressure source of the GM cryocooler 10. The cold head 14 is also called an expander.

As will be described in detail later, the compressor 12 supplies a high-pressure (PH) working gas from the compressor discharge port 12*a* to the cold head 14. The cold head 14 is provided with a regenerator 15 which precools the working gas. The precooled working gas is further cooled by expansion in the cold head 14. The working gas is recovered to the compressor suction port 12*b* through the regenerator 15. The working gas cools the regenerator 15 when passes through the regenerator 15. The compressor 12 compresses the recovered low-pressure (PL) working gas and supplies it to the cold head 14 again.

The cold head 14 which is shown is a single stage type. However, the cold head 14 may be a multistage type.

The cold head 14 is a gas-driven type. Therefore, the cold head 14 includes an axially movable body 16 as a free piston which is driven by gas pressure, and a cold head housing 18 which is airtightly configured and accommodates the axially movable body 16. The cold head housing 18 supports the axially movable body 16 so as to be capable of reciprocating in the axial direction. Unlike a motor-driven type GM cryocooler, the cold head 14 does not have a motor for driving the axially movable body 16 and a connection mechanism (for example, a scotch yoke mechanism).

The axially movable body 16 includes a displacer 20 capable of reciprocating in the axial direction (in FIG. 1, an up-down direction indicated by an arrow C), and a drive piston 22 connected to the displacer 20 so as to drive the displacer 20 in the axial direction. The drive piston 22 is disposed coaxially with the displacer 20 and apart from the displacer 20 in the axial direction.

The cold head housing 18 includes a displacer cylinder 26 which accommodates the displacer 20, and a piston cylinder 28 which accommodates the drive piston 22. The piston cylinder 28 is disposed coaxially with the displacer cylinder 26 and adjacent to the displacer cylinder 26 in the axial direction. As will be described in detail later, a drive part of the cold head 14 which is a gas-driven type is configured to include the drive piston 22 and the piston cylinder 28.

Further, the axially movable body 16 includes a connecting rod 24 which rigidly connects the displacer 20 to the drive piston 22 such that the displacer 20 reciprocates in the axial direction integrally with the drive piston 22. The connecting rod 24 also extends from the displacer 20 to the drive piston 22 coaxially with the displacer 20 and the drive piston 22.

The drive piston 22 has a small dimension than the displacer 20. The axial length of the drive piston 22 is shorter than that of the displacer 20, and the diameter of the drive piston 22 is also smaller than that of the displacer 20. The diameter of the connecting rod 24 is smaller than that of the drive piston 22.

The volume of the piston cylinder 28 is smaller than that of the displacer cylinder 26. The axial length of the piston cylinder 28 is shorter than that of the displacer cylinder 26, and the diameter of the piston cylinder 28 is also smaller than that of the displacer cylinder 26.

The dimensional relationship between the drive piston 22 and the displacer 20 is not limited to that described above and may be different from that described above. Similarly, the dimensional relationship between the piston cylinder 28 and the displacer cylinder 26 is not limited to that described above and may be different from that described above. For example, the drive piston 22 may be a tip portion of the connecting rod 24, and the diameter of the drive piston 22 may be equal to the diameter of the connecting rod 24.

The axial reciprocation of the displacer 20 is guided by the displacer cylinder 26. Typically, each of the displacer 20 and the displacer cylinder 26 is a cylindrical member which extends in the axial direction, and the inner diameter of the displacer cylinder 26 coincides with or is slightly larger than the outer diameter of the displacer 20. Similarly, the axial reciprocation of the drive piston 22 is guided by the piston cylinder 28. Typically, each of the drive piston 22 and the piston cylinder 28 is a cylindrical member which extends in the axial direction, and the inner diameter of the piston cylinder 28 coincides with or is slightly larger than the outer diameter of the drive piston 22.

The displacer 20 and the drive piston 22 are rigidly connected to each other by the connecting rod 24, and therefore, the axial stroke of the drive piston 22 is equal to the axial stroke of the displacer 20, and the displacer 20 and the drive piston 22 move integrally over the entire stroke. The position of the drive piston 22 with respect to the displacer 20 remains unchanged during the axial reciprocation of the axially movable body 16.

Further, the cold head housing 18 has a connecting rod guide 30 connecting the displacer cylinder 26 to the piston cylinder 28. The connecting rod guide 30 extends from the displacer cylinder 26 to the piston cylinder 28 coaxially with the displacer cylinder 26 and the piston cylinder 28. The connecting rod 24 passes through the connecting rod guide 30. The connecting rod guide 30 is configured as a bearing for guiding the axial reciprocation of the connecting rod 24.

The displacer cylinder 26 is airtightly connected to the piston cylinder 28 through the connecting rod guide 30. In this way, the cold head housing 18 is configured as a pressure container for the working gas. The connecting rod guide 30 may be regarded as a part of either the displacer cylinder 26 or the piston cylinder 28.

A first seal part 32 is provided between the connecting rod 24 and the connecting rod guide 30. The first seal part 32 is mounted to one of the connecting rod 24 and the connecting rod guide 30 and slides on the other of the connecting rod 24 and the connecting rod guide 30. The first seal part 32 is configured with, for example, a seal member such as a slipper seal or an O-ring. The piston cylinder 28 is configured to be airtight with respect to the displacer cylinder 26 due to the first seal part 32. In this way, the piston cylinder 28 is fluidly isolated from the displacer cylinder 26, and thus a direct gas flow between the piston cylinder 28 and the displacer cylinder 26 does not occur.

The displacer cylinder 26 is partitioned into an expansion chamber 34 and a room temperature chamber 36 by the displacer 20. The displacer 20 forms the expansion chamber 34 between itself and the displacer cylinder 26 at one end thereof in the axial direction, and forms the room temperature chamber 36 between itself and the displacer cylinder 26 at the other end thereof in the axial direction. The expansion chamber 34 is disposed on the bottom dead center LP1 side, and the room temperature chamber 36 is disposed on the top dead center UP1 side. Further, the cold head 14 is provided with a cooling stage 38 fixed to the displacer cylinder 26 so as to enclose the expansion chamber 34.

The regenerator 15 is built in the displacer 20. The displacer 20 has, in an upper lid portion thereof, an inlet flow path 40 which makes the regenerator 15 communicate with the room temperature chamber 36. Further, the displacer 20 has, in a tubular portion thereof, an outlet flow path 42 which makes the regenerator 15 communicate with the expansion chamber 34. Alternatively, the outlet flow path 42 may be provided in a lower lid portion of the displacer 20. In addition, the regenerator 15 includes an inlet retainer 41 which is inscribed in the upper lid portion, and an outlet retainer 43 which is inscribed in the lower lid portion. A regenerator material may be, for example, a wire mesh made of copper. The retainer may be a wire mesh coarser than the regenerator material.

A second seal part 44 is provided between the displacer 20 and the displacer cylinder 26. The second seal part 44 is, for example, a slipper seal and is mounted to the tubular portion or the upper lid portion of the displacer 20. The clearance between the displacer 20 and the displacer cylinder 26 is sealed by the second seal part 44, and therefore, a direct gas flow between the room temperature chamber 36 and the expansion chamber 34 (that is, a gas flow bypassing the regenerator 15) does not occur.

When the displacer 20 moves in the axial direction, the expansion chamber 34 and the room temperature chamber 36 complementarily increase or decrease in volume. That is, when the displacer 20 moves downward, the expansion chamber 34 narrows and the room temperature chamber 36 widens. The reverse is also true.

The working gas flows from the room temperature chamber 36 into the regenerator 15 through the inlet flow path 40. More precisely, the working gas flows from the inlet flow path 40 into the regenerator 15 through the inlet retainer 41. The working gas flows from the regenerator 15 into the expansion chamber 34 via the outlet retainer 43 and the outlet flow path 42. When the working gas returns from the expansion chamber 34 to the room temperature chamber 36, it passes through the reverse pathway. That is, the working gas returns from the expansion chamber 34 to the room temperature chamber 36 through the outlet flow path 42, the regenerator 15, and the inlet flow path 40. The working gas which bypasses the regenerator 15 and tries to flow through the clearance is cut off by the second seal part 44.

The piston cylinder 28 includes a drive chamber 46 in which pressure is controlled so as to drive the drive piston 22, and a gas spring chamber 48 separated from the drive chamber 46 by the drive piston 22. The drive piston 22 forms the drive chamber 46 between itself and the piston cylinder 28 at one end thereof in the axial direction, and forms the gas spring chamber 48 between itself and the piston cylinder 28 at the other end thereof in the axial direction. When the drive piston 22 moves in the axial direction, the drive chamber 46 and the gas spring chamber 48 complementarily increase or decrease in volume.

The drive chamber 46 is disposed on the side opposite to the displacer cylinder 26 in the axial direction with respect to the drive piston 22. The gas spring chamber 48 is disposed on the same side as the displacer cylinder 26 in the axial direction with respect to the drive piston 22. In other words, the drive chamber 46 is disposed on the top dead center UP2 side, and the gas spring chamber 48 is disposed on the bottom dead center LP2 side. The upper surface of the drive piston 22 receives the gas pressure in the drive chamber 46, and the lower surface of the drive piston 22 receives the gas pressure in the gas spring chamber 48.

The connecting rod 24 extends from the lower surface of the drive piston 22 to the connecting rod guide 30 through the gas spring chamber 48. Further, the connecting rod 24 extends to the upper lid portion of the displacer 20 through the room temperature chamber 36. The gas spring chamber 48 is disposed on the same side as the connecting rod 24 with respect to the drive piston 22, and the drive chamber 46 is disposed on the side opposite to the connecting rod 24 with respect to the drive piston 22.

A third seal part 50 which is a clearance between the drive piston 22 and the piston cylinder 28 is provided between the drive piston 22 and the piston cylinder 28. The third seal part 50 acts as flow path resistance to a gas flow between the drive chamber 46 and the gas spring chamber 48. The third seal part 50 may have a seal member such as a slipper seal mounted on the side surface of the drive piston 22 so as to seal the clearance. In that case, the gas spring chamber 48 is sealed by the first seal part 32 and the third seal part 50.

When the drive piston 22 moves downward, the gas spring chamber 48 narrows. At this time, the gas in the gas spring chamber 48 is compressed to increase the pressure. The pressure in the gas spring chamber 48 acts upward on the lower surface of the drive piston 22. Accordingly, the gas spring chamber 48 generates a gas spring force that resists the downward movement of the drive piston 22. Conversely, when the drive piston 22 moves upward, the gas spring chamber 48 widens. The pressure in the gas spring chamber 48 decreases, and the gas spring force acting on the drive piston 22 also decreases.

The cold head 14 is installed in the illustrated direction at a site where it is used. That is, the cold head 14 is installed vertically such that the displacer cylinder 26 is disposed on the lower side in the vertical direction and the piston cylinder 28 is disposed on the upper side in the vertical direction. In this manner, when the cooling stage 38 is installed in a posture in which it is directed downward in the vertical direction, the GM cryocooler 10 has the highest refrigeration capacity. However, the disposition of the GM cryocooler 10 is not limited thereto. Conversely, the cold head 14 may be installed in a posture in which the cooling stage 38 is directed upward in the vertical direction. Alternatively, the cold head 14 may be installed sideways or in other directions.

Further, the GM cryocooler 10 includes a working gas circuit 52 that connects the compressor 12 to the cold head 14. The working gas circuit 52 is configured to create a pressure difference between the piston cylinder 28 (that is, the drive chamber 46) and the displacer cylinder 26 (that is, the expansion chamber 34 and/or the room temperature chamber 36). The axially movable body 16 moves in the axial direction due to the pressure difference. If the pressure in the displacer cylinder 26 is low with respect to the piston cylinder 28, the drive piston 22 moves downward, and the displacer 20 also moves downward accordingly. Conversely, if the pressure in the displacer cylinder 26 is high with respect to the piston cylinder 28, the drive piston 22 moves upward, and the displacer 20 also moves upward accordingly.

The working gas circuit 52 includes a valve unit 54. The valve unit 54 may be disposed in the cold head housing 18 and connected to the compressor 12 by a pipe. The valve unit 54 may be disposed outside the cold head housing 18 and connected to each of the compressor 12 and the cold head 14 by a pipe.

The valve unit 54 includes a main pressure switching valve 60 and an auxiliary pressure switching valve 62. The main pressure switching valve 60 has a main intake on-off valve V1 and a main exhaust on-off valve V2. The auxiliary pressure switching valve 62 has an auxiliary intake on-off valve V3 and an auxiliary exhaust on-off valve V4.

The main pressure switching valve 60 is disposed in a main intake and exhaust flow path 64 which connects the compressor 12 to the room temperature chamber 36 of the cold head 14. The main intake and exhaust flow path 64 branches into a main intake path 64*a* and a main exhaust path 64*b* at the main pressure switching valve 60. The main intake on-off valve V1 is disposed in the main intake path 64*a* and connects the compressor discharge port 12*a* to the room temperature chamber 36. The main exhaust on-off valve V2 is disposed in the main exhaust path 64*b* and connects the compressor suction port 12*b* to the room temperature chamber 36.

The main pressure switching valve 60 is configured to make the compressor discharge port 12*a* or the compressor suction port 12*b* selectively communicate with the room temperature chamber 36 of the displacer cylinder 26. In the main pressure switching valve 60, each of the main intake on-off valve V1 and the main exhaust on-off valve V2 is opened exclusively. That is, simultaneous opening of the main intake on-off valve V1 and the main exhaust on-off valve V2 is prohibited. When the main intake on-off valve V1 is opened, the main exhaust on-off valve V2 is closed. The working gas is supplied from the compressor discharge port 12*a* to the displacer cylinder 26 through the main intake and exhaust flow path 64. On the other hand, when the main exhaust on-off valve V2 is opened, the main intake on-off valve V1 is closed. The working gas is recovered from the displacer cylinder 26 to the compressor suction port 12*b* through the main intake and exhaust flow path 64. The main intake on-off valve V1 and the main exhaust on-off valve V2 may be temporarily closed together. In this way, the displacer cylinder 26 is alternately connected to the compressor discharge port 12*a* and the compressor suction port 12*b*.

The auxiliary pressure switching valve 62 is disposed in an auxiliary intake and exhaust flow path 66 which connects the compressor 12 to the drive chamber 46 of the piston cylinder 28. The auxiliary intake and exhaust flow path 66 branches into an auxiliary intake path 66*a* and an auxiliary exhaust path 66*b* at the auxiliary pressure switching valve 62. The auxiliary intake on-off valve V3 is disposed in the auxiliary intake path 66*a* and connects the compressor discharge port 12*a* to the drive chamber 46. The auxiliary exhaust on-off valve V4 is disposed in the auxiliary exhaust path 66*b* and connects the compressor suction port 12*b* to the drive chamber 46.

The auxiliary pressure switching valve 62 is configured to make the compressor discharge port 12*a* or the compressor suction port 12*b* selectively communicate with the drive chamber 46 of the piston cylinder 28. The auxiliary pressure switching valve 62 is configured such that each of the auxiliary intake on-off valve V3 and the auxiliary exhaust on-off valve V4 is opened exclusively. That is, simultaneous opening of the auxiliary intake on-off valve V3 and the auxiliary exhaust on-off valve V4 is prohibited. When the auxiliary intake on-off valve V3 is opened, the auxiliary exhaust on-off valve V4 is closed. The working gas is supplied from the compressor discharge port 12*a* to the drive chamber 46 through the auxiliary intake and exhaust flow path 66. On the other hand, when the auxiliary exhaust on-off valve V4 is opened, the auxiliary intake on-off valve V3 is closed. The working gas is recovered from the drive chamber 46 to the compressor suction port 12*b* through the auxiliary intake and exhaust flow path 66. The auxiliary intake on-off valve V3 and the auxiliary exhaust on-off valve V4 may be temporarily closed together. In this way, the drive chamber 46 is alternately connected to the compressor discharge port 12*a* and the compressor suction port 12*b*.

The working gas circuit 52 includes a buffer volume 68 connected between the auxiliary pressure switching valve 62 and the compressor 12. The buffer volume 68 is connected between the compressor discharge port 12*a* and the auxiliary intake on-off valve V3 and disposed in the auxiliary intake path 66*a*. A buffer volume is not provided in the auxiliary exhaust path 66*b*.

Further, the working gas circuit 52 further includes an auxiliary on-off valve V5. The auxiliary on-off valve V5 is connected between the compressor discharge port 12*a* and the buffer volume 68 and disposed in the auxiliary intake path 66*a*. As shown in FIG. 1, the auxiliary intake path 66*a* is branched from the main intake path 64*a* at a branch point 70. The branch point 70 is located between the compressor discharge port 12*a* and the main intake on-off valve V1 in the main intake path 64*a*. In the auxiliary intake path 66*a*, the auxiliary on-off valve V5, the buffer volume 68, and the auxiliary intake on-off valve V3 are disposed in this order from the branch point 70. In this manner, the auxiliary intake on-off valve V3 and the auxiliary on-off valve V5 are connected in series between the compressor discharge port 12*a* and the drive chamber 46. The buffer volume 68 is connected between the auxiliary intake on-off valve V3 and the auxiliary on-off valve V5.

The buffer volume 68 is configured to store the working gas having an intermediate pressure between the high-pressure PH and the low-pressure PL. The intermediate pressure may be any pressure between high-pressure PH and the low-pressure PL. The intermediate pressure may be a mean pressure PM of the high-pressure PH and the low-pressure PL. In this way, a larger differential pressure can be generated with respect to each of the high-pressure PH and the low-pressure PL.

When the auxiliary intake on-off valve V3 is opened, the buffer volume 68 can supply the intermediate pressure working gas to the drive chamber 46 through the auxiliary intake and exhaust flow path 66. When the auxiliary on-off valve V5 is opened, the buffer volume 68 can receive the high-pressure working gas from the compressor discharge port 12*a* through the auxiliary intake path 66*a* to restore the pressure. In this way, the working gas circuit 52 functions as an intermediate pressure source of the drive chamber 46 by including the buffer volume 68, the auxiliary intake on-off valve V3, and the auxiliary on-off valve V5.

The buffer volume 68 may have volume of two or more times the volume of the drive chamber 46. In this way, a pressure fluctuation in the buffer volume 68 can be reduced. Excessive step-down of the buffer volume 68 according to the opening of the auxiliary intake on-off valve V3 and excessive pressure rising according to the opening of the auxiliary on-off valve V5 can be avoided. Further, in order to suppress an increase in the size of the GM cryocooler 10, the buffer volume 68 may have volume equal to or less than 10 times the volume of the drive chamber 46. From such a point of view, the buffer volume 68 may have, for example, volume of three to seven times, for example, about five times the volume of the drive chamber 46.

The shape of the buffer volume 68 is arbitrary. The buffer volume 68 may be a buffer tank. Alternatively, the buffer volume 68 may extend like a pipe, and in this case, the buffer volume 68 may be a part of the auxiliary intake path 66*a* which connects the auxiliary on-off valve V5 to the auxiliary intake on-off valve V3. The buffer volume 68 may extend straight or to be curved or may have a coil shape.

The buffer volume 68 may be installed at the cold head housing 18. Alternatively, the buffer volume 68 may be installed apart from the cold head housing 18.

Instead of the auxiliary on-off valve V5, the working gas circuit 52 may have a flow path resistance such as an orifice.

The main intake on-off valve V1 is configured to be opened at a main intake start timing determined in advance and be closed at a main intake end timing. The main exhaust on-off valve V2 is configured to be opened at a main exhaust start timing determined in advance and be closed at a main exhaust end timing. The auxiliary intake on-off valve V3 is configured to be opened at an auxiliary intake start timing determined in advance and be closed at an auxiliary intake end timing. The auxiliary exhaust on-off valve V4 is configured to be opened at an auxiliary exhaust start timing determined in advance and be closed at an auxiliary exhaust end timing. The auxiliary on-off valve V5 is configured to be opened at an auxiliary intake start timing determined in advance and be closes at an auxiliary intake end timing.

The valve unit 54 may take the form of a rotary valve. In this case, a group of valves (V1 to V5) is incorporated in the valve unit 54 and driven synchronously. The valve unit 54 is configured such that the valves (V1 to V5) are properly switched by rotational sliding of a valve disc (or a valve rotor) with respect to a valve main body (or a valve stator). The group of valves (V1 to V5) is switched in the same cycle during the operation of the GM cryocooler 10, whereby the five on-off valves (V1 to V5) change an open/close state periodically. The five on-off valves (V1 to V5) are opened and closed in different phases, respectively.

The GM cryocooler 10 may include a rotary drive source 56 connected to the valve unit 54 so as to rotate the valve unit 54. The rotary drive source 56 is mechanically connected to the valve unit 54. The rotary drive source 56 is, for example, a motor. However, the rotary drive source 56 is not mechanically connected to the axially movable body 16. Further, the GM cryocooler 10 may include a control unit 58 that controls the valve unit 54. The control unit 58 may control the rotary drive source 56.

In an embodiment, the group of valves (V1 to V5) may take the form of a plurality of individually controllable valves. Each of the valves (V1 to V5) may be an electromagnetic on-off valve. In this case, the rotary drive source 56 is not provided, and each of the valves (V1 to V5) is electrically connected to the control unit 58. The control unit 58 may control the opening and closing of each of the valves (V1 to V5).

In an embodiment, the group of valves (V1 to V5) may be a combination of rotary valves and individually controllable valves. For example, the main pressure switching valve 60 and the auxiliary pressure switching valve 62 (that is, V1 to V4) may be configured as rotary valves and the auxiliary on-off valve V5 may be an on-off valve different from the rotary valve.

Figure 2:
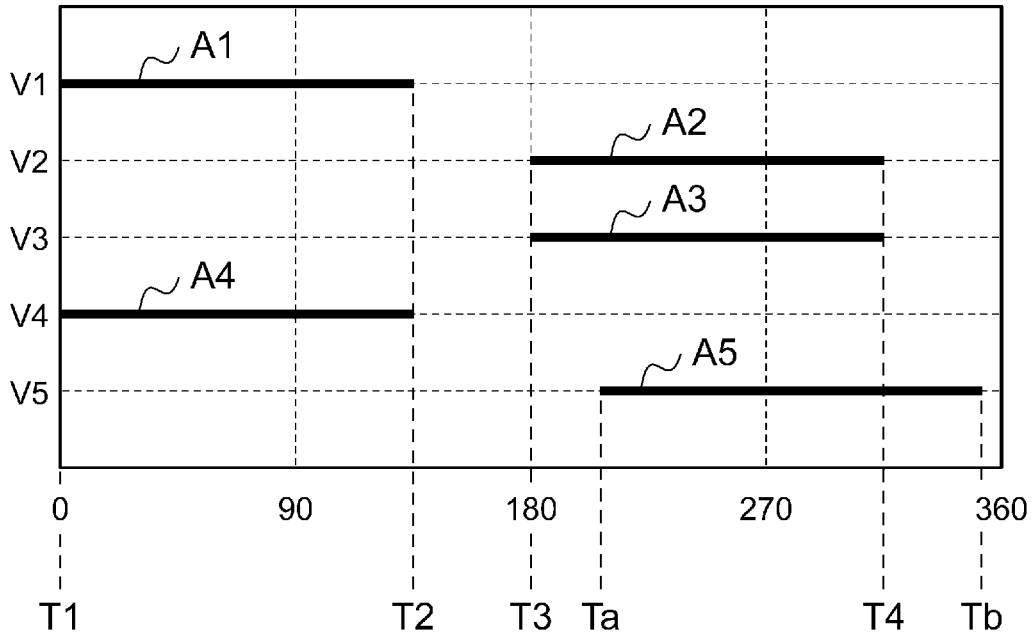
FIG. 2 is a diagram illustrating valve timings in the GM cryocooler shown in FIG. 1.

FIG. 2 is a diagram illustrating valve timings in the GM cryocooler 10 shown in FIG. 1. In FIG. 2, one cycle of the axial reciprocation of the axially movable body 16 is shown in association with 360 degrees, and therefore, 0 degrees corresponds to a start time point of the cycle and 360 degrees corresponds to an end time point of the cycle. 90 degrees, 180 degrees, and 270 degrees respectively correspond to a quarter cycle, a half cycle, and a ¾ cycle. At 0 degrees, the displacer 20 and the drive piston 22 are located at or near the bottom dead centers LP1 and LP2, and at 180 degrees, the displacer 20 and the drive piston 22 are located at or near the top dead centers UP1 and UP2.

In FIG. 2, a first intake period A1 and a first exhaust period A2 of the cold head 14 and a second intake period A3 and a second exhaust period A4 of the drive chamber 46 are illustrated. The first intake period A1, the first exhaust period A2, the second intake period A3, and the second exhaust period A4 are respectively determined by the main intake on-off valve V1, the main exhaust on-off valve V2, the auxiliary intake on-off valve V3, and the auxiliary exhaust on-off valve V4. In addition, in FIG. 2, an auxiliary intake period A5 which is determined by the auxiliary on-off valve V5 is illustrated.

In the first intake period A1 (that is, when the main intake on-off valve V1 is opened), the working gas flows from the compressor discharge port 12*a* to the room temperature chamber 36 through the main intake on-off valve V1 and the main intake and exhaust flow path 64. Conversely, when the main intake on-off valve V1 is closed, the supply of the working gas from the compressor 12 to the room temperature chamber 36 is stopped. The first intake period A1 is started from a main intake start timing T1 and ended at a main intake end timing T2. The main intake start timing T1 is selected from, for example, a range of 0 degrees to 90 degrees. The main intake start timing T1 is, for example, 0 degrees. The main intake end timing T2 is selected from, for example, a range of 90 degrees to 180 degrees. The main intake end timing T2 is, for example, 135 degrees.

In the first exhaust period A2 (that is, when the main exhaust on-off valve V2 is opened), the working gas flows from the room temperature chamber 36 to the compressor suction port 12*b* through the main exhaust on-off valve V2 and the main intake and exhaust flow path 64. When the main exhaust on-off valve V2 is closed, the recovery of the working gas from the room temperature chamber 36 to the compressor 12 is stopped. The first exhaust period A2 is started from a main exhaust start timing T3 and ended at a main exhaust end timing T4. The first exhaust period A2 alternates with and does not overlap the first intake period A1. The main exhaust start timing T3 is selected from, for example, a range of 180 degrees to 270 degrees. The main exhaust start timing T3 is, for example, 180 degrees. The main exhaust end timing T4 is selected from, for example, a range of 270 degrees to 360 degrees. The main exhaust end timing T4 is, for example, 315 degrees.

In the second intake period A3 (that is, when the auxiliary intake on-off valve V3 is opened), the working gas flows from the buffer volume 68 to the drive chamber 46 through the auxiliary intake on-off valve V3 and the auxiliary intake and exhaust flow path 66. When the auxiliary intake on-off valve V3 is closed, the supply of the working gas from the buffer volume 68 to the drive chamber 46 is stopped. The second intake period A3 is started from the auxiliary intake start timing and ended at the auxiliary intake end timing. In the valve timings shown in FIG. 2, the auxiliary intake start timing coincides with the main exhaust start timing T3 and the auxiliary intake end timing coincides with the main exhaust end timing T4. However, there is no limitation thereto. The second intake period A3 at least partially overlaps the first exhaust period A2. The auxiliary intake start timing may be selected from, for example, a range of 180 degrees to 270 degrees, and the auxiliary intake end timing may be selected from, for example, a range of 270 degrees to 360 degrees.

In the second exhaust period A4 (that is, when the auxiliary exhaust on-off valve V4 is opened), the working gas flows from the drive chamber 46 to the compressor suction port 12*b* through the auxiliary exhaust on-off valve V4 and the auxiliary intake and exhaust flow path 66. When the auxiliary exhaust on-off valve V4 is closed, the recovery of the working gas from the drive chamber 46 to the compressor 12 is stopped. The second exhaust period A4 is started from the auxiliary exhaust start timing and ended at the auxiliary exhaust end timing. The second exhaust period A4 alternates with and does not overlap the second intake period A3. In the valve timings shown in FIG. 2, the auxiliary exhaust start timing coincides with the main intake start timing T1 and the auxiliary exhaust end timing coincides with the main intake end timing T2. However, there is no limitation thereto. The second exhaust period A4 at least partially overlaps the first intake period A1. The auxiliary exhaust start timing may be selected from, for example, a range of 0 degrees to 90 degrees, and the auxiliary exhaust end timing may be selected from, for example, a range of 90 degrees to 180 degrees.

In the auxiliary intake period A5 (that is, when the auxiliary on-off valve V5 is opened), the working gas flows from the compressor discharge port 12*a* to the buffer volume 68 through the auxiliary on-off valve V5. When the auxiliary on-off valve V5 is closed, the supply of the working gas from the compressor 12 to the room temperature chamber 36 is stopped.

The auxiliary intake period A5 is started from an auxiliary intake start timing Ta and ended at an auxiliary intake end timing Tb. The auxiliary intake period A5 is started later and ended later than the first exhaust period A2 and the second intake period A3. The auxiliary intake period A5 partially overlaps the first exhaust period A2 and the second intake period A3. That is, the auxiliary intake start timing Ta is after the main exhaust start timing T3 and the auxiliary intake start timing. The auxiliary intake end timing Tb is later than the main exhaust end timing T4 and the auxiliary intake end timing. The auxiliary intake start timing Ta may be selected from, for example, a range of 180 degrees to 270 degrees, and the auxiliary intake end timing Tb may be selected from, for example, a range of 270 degrees to 360 degrees. Further, the auxiliary intake period A5 is ended before the start of the first intake period A1 and the second exhaust period A4 and does not overlap the start of the first intake period A1 and the second exhaust period A4.

However, the auxiliary intake period A5 is not limited thereto. The auxiliary intake period A5 may be performed any time as far as the pressure in the buffer volume 68 is restored to the intermediate pressure. The auxiliary intake period A5 may not overlap the first exhaust period A2 and the second intake period A3. The auxiliary intake period A5 may at least partially overlap the first intake period A1 and/or the second exhaust period A4. The auxiliary intake start timing Ta and the auxiliary intake end timing Tb may be any time point between 0 degrees and 360 degrees.

Further, it is not essential that the auxiliary intake period A5 be continuous as a single period during one cycle. A plurality of auxiliary intake periods A5 may be set during one cycle. In other words, the opening and closing of the auxiliary on-off valve V5 may be repeated multiple times during one cycle.

Figure 3:
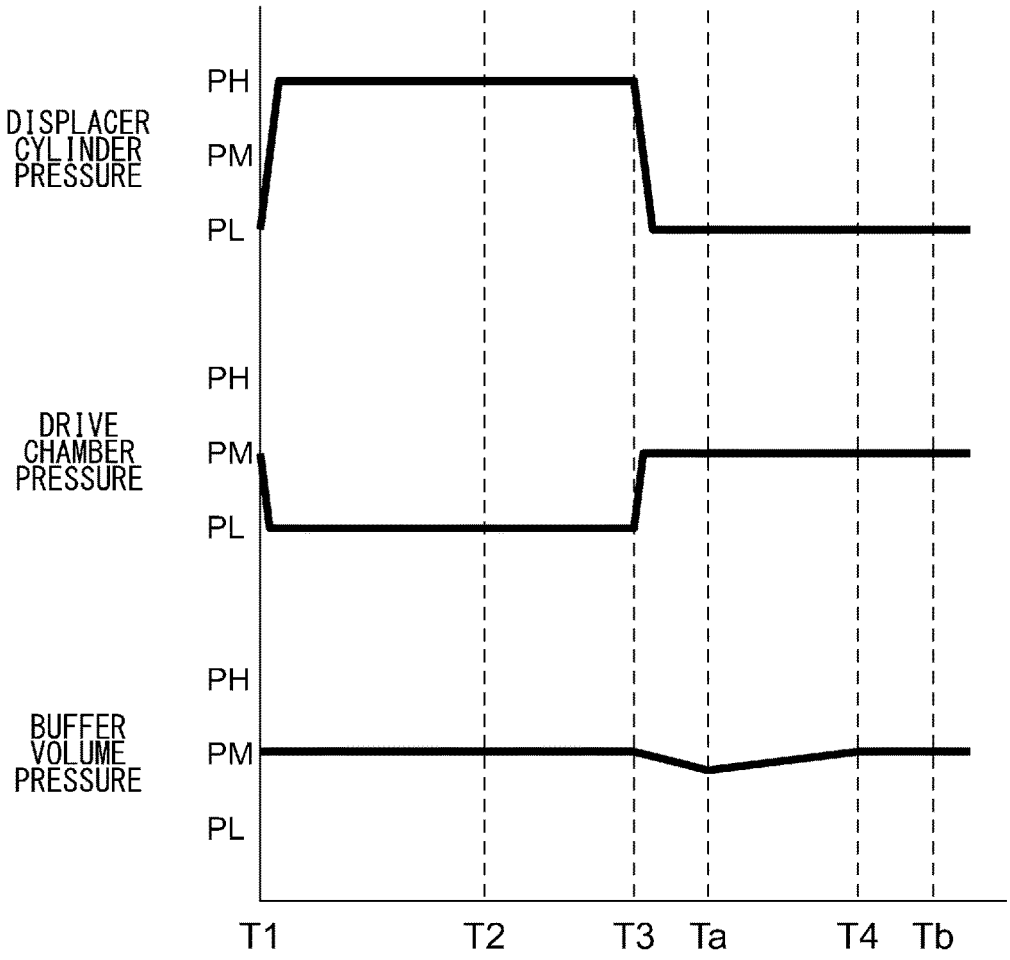
FIG. 3 is a schematic diagram showing operation waveforms of the GM cryocooler, which are obtained when the GM cryocooler operates according to the valve timings shown in FIG. 2, over one cycle.

FIG. 3 is a schematic diagram showing operation waveforms in the GM cryocooler 10, which are obtained when the GM cryocooler 10 operates according to the valve timings shown in FIG. 2, over one cycle. In FIG. 3, the pressure in the displacer cylinder 26, the pressure in the drive chamber 46, and the pressure in the buffer volume 68 are shown in order from the top.

The operation of the GM cryocooler 10 having the above configuration will be described with reference to FIGS. 1 to 3. When the displacer 20 is at or near the bottom dead center LP1, the first intake period A1 is started (the main intake start timing T1 in FIGS. 2 and 3). The main intake on-off valve V1 is opened, and thus the working gas having the high-pressure PH is supplied from the compressor discharge port 12*a* to the room temperature chamber 36 of the cold head 14. The gas is cooled while passing through the regenerator 15, and then enters the expansion chamber 34.

The second exhaust period A4 is also started at the same time as the first intake period A1. The auxiliary exhaust on-off valve V4 is opened, and the drive chamber 46 of the piston cylinder 28 is connected to the compressor suction port 12*b*. Accordingly, the drive chamber 46 has the low-pressure PL.

The driving force due to the differential pressure PH-PL acts upward on the drive piston 22. The drive piston 22 moves from the bottom dead center LP2 toward the top dead center UP2. The displacer 20 also moves from the bottom dead center LP1 toward the top dead center UP1 together with drive piston 22.

The main intake on-off valve V1 is closed, and the first intake period A1 is ended (the main intake end timing T2 in FIGS. 2 and 3). At the same time, the auxiliary exhaust on-off valve V4 is closed, and the second exhaust period A4 is ended. The drive piston 22 and the displacer 20 continue to move toward the top dead centers UP1 and UP2. In this way, the volume of the expansion chamber 34 is increased and filled with the high-pressure gas.

When the displacer 20 is at or near the top dead center UP1, the first exhaust period A2 is started (the main exhaust start timing T3 in FIGS. 2 and 3). The main exhaust on-off valve V2 is opened, and the cold head 14 is connected to the suction port of the compressor 12. The high-pressure gas expands and is cooled in the expansion chamber 34. The expanded gas is recovered to the compressor 12 via the room temperature chamber 36 while cooling the regenerator 15.

The second intake period A3 is also started at the same time as the first exhaust period A2. The auxiliary intake on-off valve V3 is opened, and the drive chamber 46 of the piston cylinder 28 is connected to the buffer volume 68. The working gas having the mean pressure PM is supplied from the buffer volume 68 to the drive chamber 46 of the piston cylinder 28, and thus the drive chamber 46 has the mean pressure PM.

The driving force due to the differential pressure PM-PL acts downward on the drive piston 22. The drive piston 22 moves from the top dead center UP2 toward the bottom dead center LP2. The pressure in the buffer volume 68 is somewhat lowered from the mean pressure PM. The displacer 20 also moves from the top dead center UP1 toward the bottom dead center LP1 together with drive piston 22.

The auxiliary intake period A5 is started (the auxiliary intake start timing Ta in FIGS. 2 and 3) in the middle of the second intake period A3. The auxiliary on-off valve V5 is opened, and the buffer volume 68 is connected to the compressor discharge port 12*a*. The working gas having the high-pressure PH is supplied from the compressor 12 to the buffer volume 68. In this way, the lowered pressure in the buffer volume 68 is restored to the mean pressure PM.

The main exhaust on-off valve V2 is closed, and the first exhaust period A2 is ended (the main exhaust end timing T4 in FIGS. 2 and 3). At the same time, the auxiliary intake on-off valve V3 is closed, and the second intake period A3 is ended. The drive piston 22 and the displacer 20 continue to move toward the bottom dead centers LP1 and LP2. In this way, the volume of the expansion chamber 34 is reduced and the low-pressure gas is discharged.

After the end of the second intake period A3, the auxiliary on-off valve V5 is closed, and the auxiliary intake period A5 is ended (the auxiliary intake end timing Tb in FIGS. 2 and 3).

The cold head 14 cools the cooling stage 38 by repeating such a cooling cycle (that is, a GM cycle). In this way, the GM cryocooler 10 can cool a superconductive device or other cooled objects (not shown) thermally coupled to the cooling stage 38.

In a case where the cold head 14 is installed in a posture in which the cooling stage 38 is directed downward in the vertical direction, gravity acts downward, as shown by an arrow D. For this reason, the self-weight of the axially movable body 16 acts to assist the downward driving force of the drive piston 22. A larger driving force acts on the drive piston 22 at the time of a downward movement than at the time of an upward movement. Accordingly, in a typical gas-driven type GM cryocooler, a collision or a contact of the displacer with the displacer cylinder easily occurs at the bottom dead center of the displacer.

However, as described above, the cold head 14 is provided with the buffer volume 68. By utilizing the buffer volume 68 as an intermediate pressure source of the drive chamber 46, the differential pressure PM-PL for moving the drive piston 22 downward becomes smaller than the differential pressure PH-PL for moving the drive piston 22 upward. In this way, the gravity acting on the drive piston 22 at the time of a downward movement is compensated.

In this way, a contact or a collision of the drive piston 22 with the piston cylinder 28 and/or a contact or a collision of the displacer 20 with the displacer cylinder 26 can be avoided. Alternatively, even if a collision occurs, since the collision energy is reduced due to a decrease in speed of the drive piston 22, collision sound is suppressed. Accordingly, vibration or abnormal noise in the gas-driven type GM cryocooler 10 can be reduced.

As described above, when the cooling stage 38 is installed in a posture in which it is directed downward in the vertical direction, the GM cryocooler 10 has the highest refrigeration capacity. The buffer volume 68 is installed between the compressor discharge port 12*a* and the auxiliary intake on-off valve V3, whereby gravity can be compensated in a case where the GM cryocooler 10 is used in a downward position.

The auxiliary on-off valve V5 can easily and reliably control the flow of the working gas between the compressor 12 and the buffer volume 68 by the opening and closing of the auxiliary on-off valve V5, compared to the flow path resistance such as an orifice. The supply of the working gas to the buffer volume 68 is allowed by the opening of the auxiliary on-off valve V5, and the supply of the working gas to the buffer volume 68 is cut off by the closing of the auxiliary on-off valve V5.

Further, the auxiliary on-off valve V5 is opened later than the intake start timing of the drive chamber 46 through the auxiliary intake on-off valve V3. The auxiliary intake period A5 is started in the middle of the second intake period A3. The pressure in the buffer volume 68 can be restored within a period in which the buffer volume 68 is used as a working gas supply source for the drive chamber 46. The pressure in the buffer volume 68 can be maintained at a desired level while the buffer volume 68 is in use. Further, it is possible to make the size of the buffer volume 68 small, compared to a case where the auxiliary intake period A5 is started after the end of the second intake period A3.

In addition, the cold head 14 includes a gas spring mechanism that acts on the drive piston 22 so as to relieve or prevent a collision or a contact of the displacer 20 with the displacer cylinder 26, as described above. The cold head 14 is provided with the gas spring chamber 48. The gas stored in the gas spring chamber 48 is compressed when the drive piston 22 moves downward, and the pressure increases. The pressure acts in the opposite direction to gravity, and therefore, the driving force acting on the drive piston 22 is reduced. The speed immediately before the drive piston 22 reaches the bottom dead center LP2 can be reduced. Such a gas spring mechanism is also helpful to avoid a contact or a collision of the axially movable body 16 with the cold head housing 18.

Another Embodiment

Figure 4:
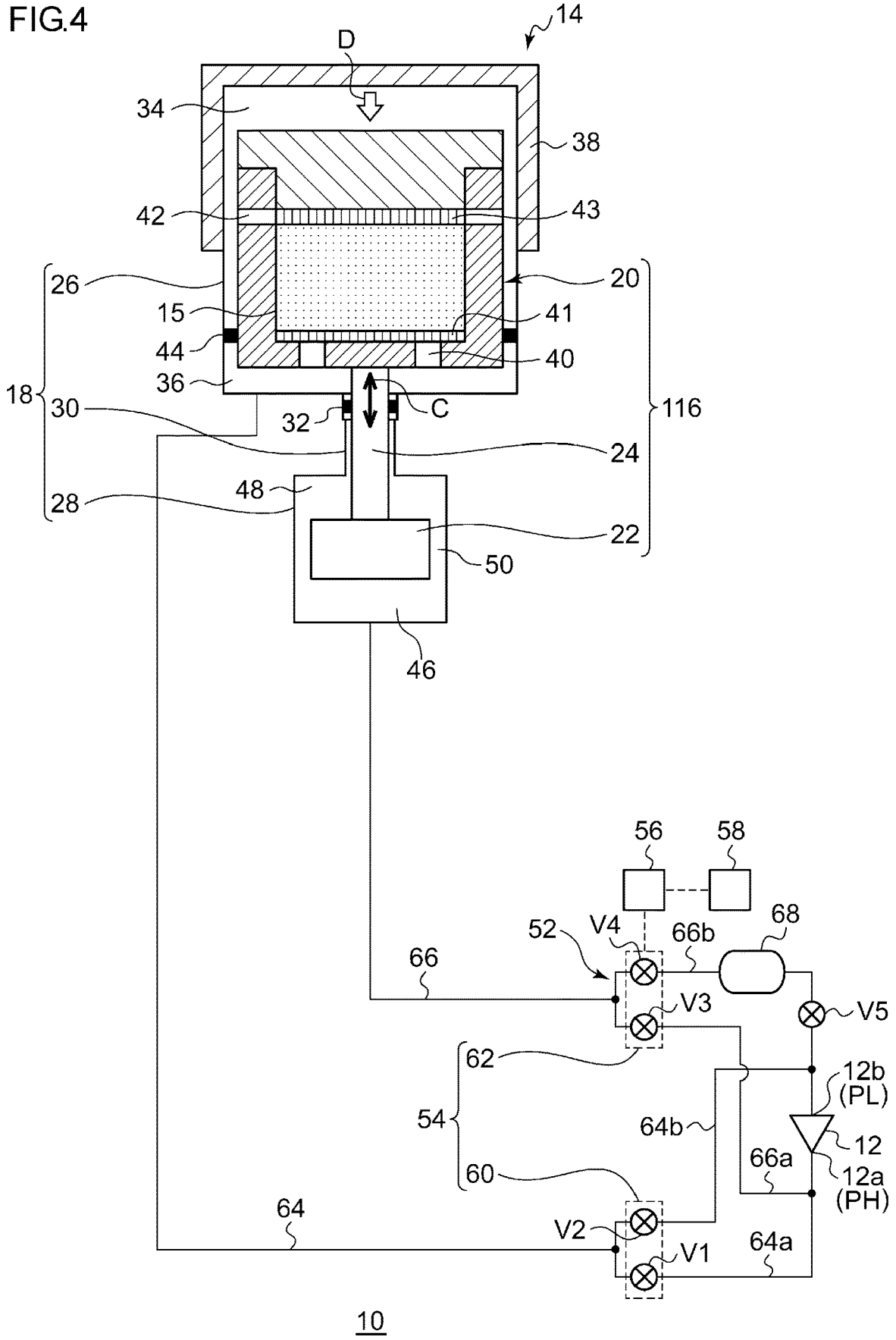
FIG. 4 is a diagram schematically showing a gas-driven type GM cryocooler according to another embodiment
Figure 5:
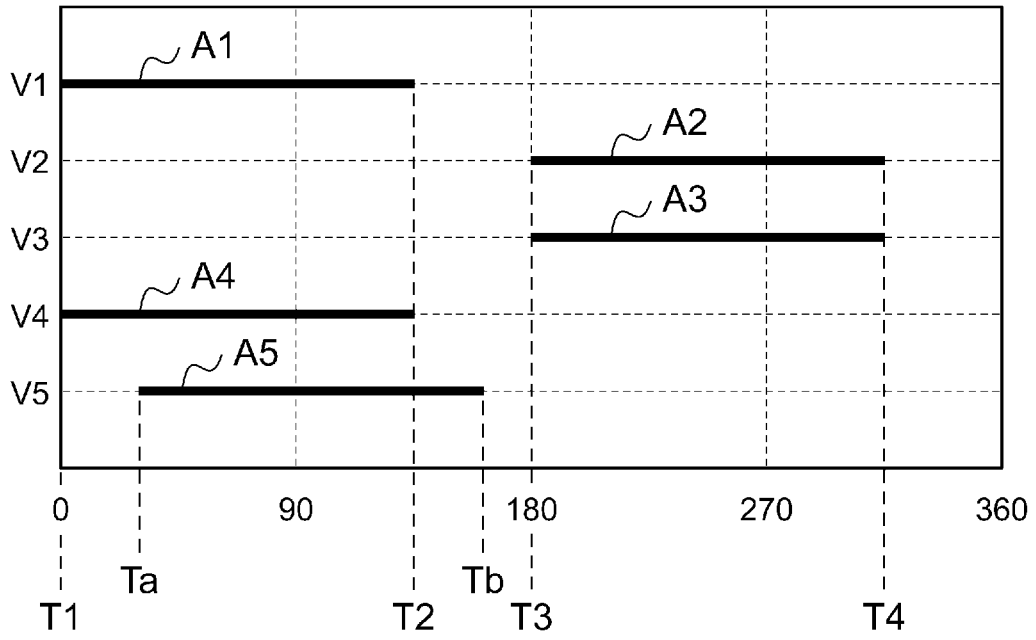
FIG. 5 is a diagram illustrating valve timings in the GM cryocooler shown in FIG. 4.

FIG. 4 is a diagram schematically showing a gas-driven type GM cryocooler according to another embodiment. FIG. 5 is a diagram illustrating valve timings in the GM cryocooler shown in FIG. 4. The GM cryocooler 10 according to another embodiment has a configuration suitable for a case where the cooling stage 38 is installed in a posture in which it is directed upward in the vertical direction.

With respect to the configurations which are shared by the GM cryocooler 10 according to one embodiment, among the configurations of the GM cryocooler 10 according to another embodiment, the above description is incorporated. The configurations which are common in the GM cryocooler 10 according to the one embodiment and another embodiment are denoted by the same reference numerals, and overlapping description thereof is appropriately omitted in order to avoid redundancy.

As shown in FIG. 4, the buffer volume 68 is connected between the compressor suction port 12*b* and the auxiliary exhaust on-off valve V4. The auxiliary on-off valve V5 is connected between the compressor suction port 12*b* and the buffer volume 68. The buffer volume 68 and the auxiliary on-off valve V5 are disposed in the auxiliary exhaust path 66*b*. The working gas circuit 52 functions as an intermediate pressure source of the drive chamber 46 by including the buffer volume 68, the auxiliary exhaust on-off valve V4, and the auxiliary on-off valve V5. A buffer volume is not provided in the auxiliary intake path 66*a*.

The auxiliary on-off valve V5 is opened later than the exhaust start timing of the drive chamber 46 through the auxiliary exhaust on-off valve V4. The auxiliary intake period A5 is started later and ended later than the first intake period A1 and the second exhaust period A4. The auxiliary intake period A5 partially overlaps the first intake period A1 and the second exhaust period A4. That is, the auxiliary intake start timing Ta is later than the main intake start timing T1 and the auxiliary exhaust start timing. The auxiliary intake end timing Tb is later than the main intake end timing T2 and the auxiliary exhaust end timing. The auxiliary intake start timing Ta may be selected from, for example, a range of 0 degrees to 90 degrees, and the auxiliary intake end timing Tb may be selected from, for example, a range of 90 degrees to 180 degrees. The auxiliary intake period A5 is ended before the start of the first exhaust period A2 and the second intake period A3 and does not overlap the first exhaust period A2 and the second intake period A3.

When the displacer 20 moves downward in the first intake period A1, a downward driving force based on the differential pressure PH-PM acts on the drive piston 22. On the other hand, when the displacer 20 moves upward in the first exhaust period A2, an upward driving force based on the differential pressure PH-PL acts on the drive piston 22. The differential pressure PM-PL for moving the drive piston 22 downward is smaller than the differential pressure PH-PL for moving the drive piston 22 upward. In this way, the gravity acting on the drive piston 22 at the time of a downward movement is compensated. Therefore, also in another embodiment, similar to one embodiment, it is possible to reduce vibration or abnormal noise in the gas-driven type GM cryocooler 10.

The present invention has been described above based on the examples. It is to be understood by those skilled in the art that the present invention is not limited to the above embodiments, various design changes are possible, various modification examples are possible, and such modification examples are also within the scope of the present invention.

The present invention has been described above based on the examples. It is to be understood by those skilled in the art that the present invention is not limited to the above embodiments, various design changes are possible, various modification examples are possible, and such modification examples are also within the scope of the present invention.

It should be understood that the invention is not limited to the above-described embodiment, but may be modified into various forms on the basis of the spirit of the invention. Additionally, the modifications are included in the scope of the invention.

What is claimed is:

1. A GM cryocooler comprising:

a compressor having a compressor discharge port and a compressor suction port;

a displacer capable of reciprocating in an axial direction;

a displacer cylinder which accommodates the displacer;

a drive piston connected to the displacer so as to drive the displacer in the axial direction;

a drive chamber in which the drive piston is driven;

a main pressure switching valve configured to alternately connect the displacer cylinder to the compressor discharge port and the compressor suction port;

an auxiliary pressure switching valve configured to alternately connect the drive chamber to the compressor discharge port and the compressor suction port;

a buffer volume connected between the auxiliary pressure switching valve and the compressor; and a second auxiliary intake on-off valve connected between the compressor discharge port and the buffer volume, wherein the auxiliary pressure switching valve includes an auxiliary intake on-off valve that connects the compressor discharge port to the drive chamber, and an auxiliary exhaust on-off valve that connects the compressor suction port to the drive chamber, wherein the buffer volume is connected between the compressor discharge port and the auxiliary intake on-off valve, and wherein the second auxiliary on-off valve is opened after an intake start timing of the drive chamber through the auxiliary intake on-off valve.

* * * * *